US006282391B1

(12) United States Patent
Takeda

(10) Patent No.: US 6,282,391 B1
(45) Date of Patent: Aug. 28, 2001

(54) IMAGE FORMING APPARATUS USING MAGNETIC BRUSH CHARGING METHOD AND TWO-COMPONENT DEVELOPING METHOD

(75) Inventor: Atsushi Takeda, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/629,869

(22) Filed: Aug. 1, 2000

(30) Foreign Application Priority Data

Aug. 5, 1999 (JP) ..... 11-222828

(51) Int. Cl.[7] ..... G03G 15/02
(52) U.S. Cl. ..... 399/175; 430/111; 430/902
(58) Field of Search ..... 399/174, 175, 399/267; 430/108, 111, 902

(56) References Cited

U.S. PATENT DOCUMENTS 5,659,852 * 8/1997 Chigono et al. ..... 399/175
5,809,379 9/1998 Yano et al. ..... 399/159
5,930,566 * 7/1999 Ishiyama ..... 399/174 X
5,937,245 * 8/1999 Inoue et al. ..... 399/175
5,952,101 * 9/1999 Nishiguchi et al. ..... 399/174 X
6,002,900 * 12/1999 Ishiyama ..... 399/174 X

* cited by examiner

*Primary Examiner*—Joan Pendegrass
(74) *Attorney, Agent, or Firm*—Fitzpatrick, Cella, Harper & Scinto

(57) ABSTRACT

An image forming apparatus where the resistivity value of magnetic carrier in a developer of a two-component developing device is higher than that of magnetic particles for charging in a magnetic brush contact charger, the charging performance of the magnetic brush charging is prevented from being lowered even when the magnetic carrier is mixed into the magnetic brush contact charger, and thus, a satisfactory image without fog, unevenness in the image, and the like can be obtained for a long time even when it is applied to a cleanerless system according to the cleaning method simultaneous with developing. In case A=log Rv/Rc, B=lv/lc, $\alpha=\frac{1}{5}\cdot B/A\cdot lv$, and $\beta=B/A\cdot lv$ wherein Rc is the volume resistivity of the magnetic particles of the magnetic brush charger, lc is the average particle diameter of the magnetic particles, Rv is the volume resistivity of the magnetic carrier of the two-component developer, and lv is the average particle diameter of the magnetic carrier, when $A/B\geqq 2$, $C\geqq 5\%$ wherein C (%) is the ratio in volume of magnetic particles having the particle diameters ranging from $\alpha$ to $\beta$ the whole magnetic particles.

10 Claims, 8 Drawing Sheets

IMAGE FORMING APPARATUS USING MAGNETIC BRUSH CHARGING METHOD AND TWO-COMPONENT DEVELOPING METHOD

BACKGROUND OF THE INVENTION

1. Field of the Invention

The present invention relates to an image forming apparatus such as a copier and a printer using the electrophotographic process or the electrostatic recording process.

2. Related Background Art

FIG. 8 schematically illustrates an example of a conventional image forming apparatus. The image forming apparatus is a transfer type electrophotographic apparatus, and is used as a copier, a printer, a facsimile machine, or the like.

The image forming apparatus has a photosensitive drum (drum-shaped electrophotographic photosensitive member) 101 as an image bearing member. The photosensitive drum 101 is driven to rotate counterclockwise as indicated by an arrow at a predetermined peripheral speed.

While the photosensitive drum 101 is in a rotating process, all of its surface is subject to pre-exposure by a pre-exposing device (an eraser lamp) 102 to erase any electric memory remaining in the previous image forming process. Then, a corona charger 103 as charging means uniformly charges the photosensitive drum 101 in a predetermined polarity at a predetermined potential. Then, an image exposure L is carried out by image exposing means (such as projection imaging exposure means of an original image or laser beam scanning exposure means) which is not shown in FIG. 8, and the charge of the uniformly charged surface of the photosensitive drum 101 is selectively eliminated (the potential is damped) so as to correspond to the pattern of the exposed image to form an electrostatic latent image on the surface of the photosensitive drum 101. The electrostatic latent image is developed by a developing device 104 as developing means and is visualized as a toner image.

On the other hand, by a sheet feeding mechanism which is not shown in FIG. 8, a transfer material (such as paper) P as a recording medium is supplied between the photosensitive drum 101 and a transfer corona charger 105 as transfer means at a predetermined timing. By charging the back surface of the transfer material P in the opposite polarity to that of the toner, the toner image on the photosensitive drum 101 is electrostatically transferred to the front surface of the transfer material P.

Then, the transfer material P is electrostatically separated from the surface of the photosensitive drum 101 by a separation corona charger 106, and is introduced into a fixing device which is not shown in FIG. 8 to fix the toner image. Then, the transfer material P is outputted as an object having an image formed thereon (a copy or a print). After the toner image is transferred from the photosensitive drum 101 to the transfer material P, toner remaining on the surface of the photosensitive drum 101 after the transfer is cleaned and removed by a cleaner 107 to use the photosensitive drum 101 in the subsequent image formation.

The above-described photosensitive member as the image bearing member, and the respective means and apparatus in the image forming processes such as the charging, exposure, development, transfer, fixing, and cleaning may have various kinds of constitutions and systems. For example, as the charging means, the above-described corona charger 103 is conventionally popularly used. The corona charger 103 is disposed so as to be opposed to and so as not to be in contact with the photosensitive drum 101 such that the surface of the photosensitive drum is exposed to corona discharged from the discharge wire of the corona charger 103 to charge the surface of the photosensitive drum in the predetermined polarity at the predetermined potential.

Recently, a contact type charger has been put to practical use which has advantages over the above-described non-contact type corona charger in that the amount of the generated ozone is less, the necessary electric power is lower, and the like. The contact type charger charges the photosensitive drum by making a charging member with voltage applied thereto in contact with the photosensitive drum. Among such contact type chargers, one having a magnetic brush as the contacting and charging member is preferably used in view of the stability of the contact with the photosensitive drum.

In the contact type charger using the magnetic brush, conductive magnetic particles are magnetically forced to be borne on a magnet or on a sleeve having a magnet encapsulated therein to form the magnetic brush. The magnetic brush is made to be in contact with the photosensitive drum while the magnetic brush is stopped or rotated, and, with voltage applied thereto, the photosensitive drum is charged.

As the contacting and charging member, other than the one described in the above, a conductive fur brush having a conductive fiber formed to be brush-like and a conductive rubber roller having conductive rubber formed in the shape of a roller are also preferably used.

In particular, when such a contacting and charging member is used in connection with a photosensitive drum having a surface layer with conductive particulates dispersed therein (a charge injection layer) on an ordinary organic photoconductor or a photosensitive drum using an amorphous silicon photoconductor, the charging of the surface of the photosensitive drum is carried out according to the injection charging method, and a potential which is substantially equivalent to a DC component of charging bias applied to the contacting and charging member can be charged on the surface of the photosensitive drum (U.S. Pat. No. 5,809,379).

Since the injection charging method does not use the discharge phenomenon as in the corona charging method, the photosensitive drum can be charged with no ozone being generated and with low electric power consumption, and thus, attention is being attracted to the injection charging method.

There is also a trend toward miniaturization of the image forming apparatus. However, miniaturization of the image forming apparatus as a whole is limited simply by making smaller the respective means and apparatus in the image forming processes such as the charging, exposure, development, transfer, fixing, and cleaning.

The toner remaining on the photosensitive drum 101 after the transfer is, as described in the above, cleaned by the cleaner 107 and is collected as waste toner. It is preferable that such waste toner is not generated in view of the environmental protection. Therefore, an image forming apparatus of the cleanerless system has appeared where the cleaner 107 is eliminated, the toner remaining on the photosensitive drum 101 after the transfer is removed by the developing device 104 according to the cleaning method simultaneous with developing, and the toner remaining after the transfer is collected in the developing device 104.

The cleaning simultaneous with developing is a method which collects a little amount of toner remaining on the photosensitive drum 101 after the transfer using fog removal bias (the potential difference Vback between the DC voltage applied to the developing device and the potential on the surface of the photosensitive drum) in developing processes for the next and subsequent image formations.

According to this method, the toner remaining after the transfer is collected in the developing device 104 to be used in development in the future, and thus, waste toner can be eliminated and trouble in the maintenance can be saved. Further, since there is no cleaner, the advantage from the viewpoint of space is also great, and the image forming apparatus can be miniaturized to a large extent.

When the method is combined with the magnetic brush charger, there is an advantage that, since the toner remaining after the transfer is collected by the magnetic brush charger and is reattached to the surface of the photosensitive drum substantially uniformly, by the developing device 104 is facilitated.

However, there are following problems particularly when a developing method is adopted using the cleanerless system in combination with the injection charging method by the magnetic brush charger and using a two-component developer having non-magnetic toner and magnetic carrier (magnetic particles) mixed therein as the developer.

To improve the charging efficiency of the magnetic brush charging, it is necessary to make lower the resistivity value of the magnetic particles for charging (PCF). On the other hand, if the resistivity value of the magnetic carrier used in the developer is low, charge injection is caused at a development nip portion, the fog removal potential Vback becomes smaller, and fog is caused. Therefore, from the viewpoint of prevention of the fog, it is necessary to make high the resistivity value of the magnetic carrier for developing.

In case of a cleanerless system, if the magnetic carrier in the developer unintentionally attaches to the photosensitive member, it is collected and accumulated in the magnetic brush charger. If the resistivity value of the magnetic carrier for developing is higher than that of the magnetic particles for charging, the resistivity value of the magnetic brush charger becomes higher, and its charging performance is lowered. For example, the photosensitive member can not be charged to a desired potential, or unevenness is caused in the charge.

As a method for compensating for this phenomenon, to make smaller the average particle diameter of the magnetic particles for charging is contemplated. However, in this case, the cohesiveness of the magnetic particles becomes greater, which leads to deteriorated conveyableness of the magnetic particles and deteriorated reattachableness to the photosensitive member of the toner collected in the magnetic brush charger. Therefore, the charging performance is lowered more remarkably as the image formation is repeated.

SUMMARY OF THE INVENTION

An object of the present invention is to provide an image forming apparatus the charging performance of which is not lowered even when magnetic carrier is mixed into a magnetic brush charger.

Another object of the present invention is to provide an image forming apparatus using the magnetic brush charging method, the two-component developing method, and the cleanerless method.

Still another object of the present invention is to provide an image forming apparatus comprising an image bearing member for bearing an electrostatic image, a charger for charging the image bearing member, the charger having magnetic particles for coming into contact with the image bearing member and a supporting member for supporting the magnetic particles by magnetic force with voltage applied thereto, image forming means for selectively eliminating charge of the image bearing member charged by the charger to form an electrostatic image, and a developing device for developing the electrostatic image on the image bearing member with developer having toner and magnetic carrier, the image forming apparatus satisfying the following relationship:

$$A/B \geqq 2,\ C \geqq 5$$

$$A = \log Rv/Rc,\ B = lv/lc$$

$$\alpha = 1/5 \cdot B/A \cdot lv,\ \beta = B/A \cdot lv$$

wherein Rc is the volume resistivity of the magnetic particles, lc is the average particle diameter of the magnetic particles, Rv is the volume resistivity of the magnetic carrier, lv is the average particle diameter of the magnetic carrier, and C is the ratio (%) in volume of magnetic particles having the particle diameters ranging from $\alpha$ to $\beta$ to the whole magnetic particles.

Other objects of the present invention will become apparent from the following description.

DESCRIPTION OF THE PREFERRED EMBODIMENTS

An embodiment according to the present invention is now described in further detail with reference to the drawings.

Figure 1:
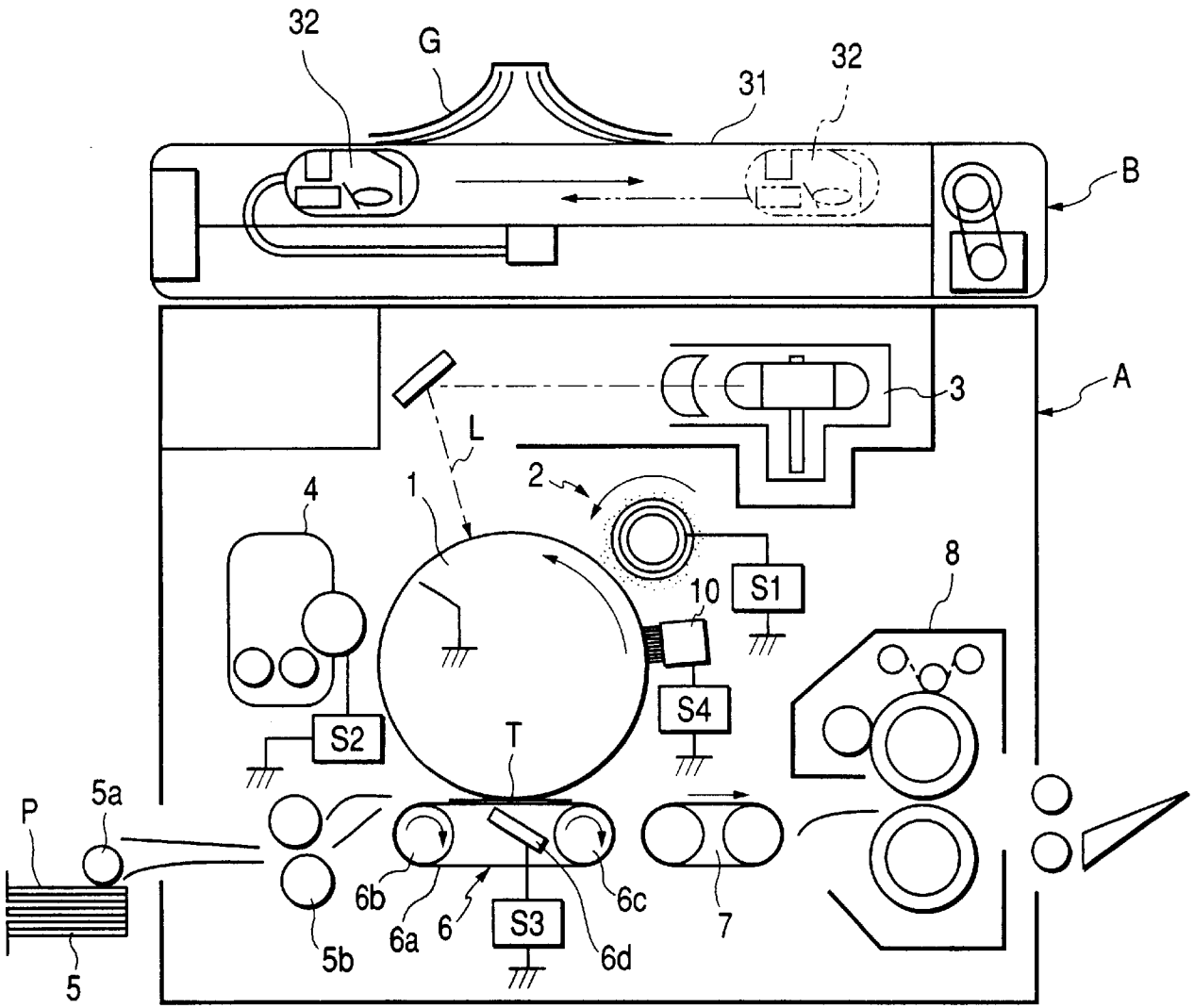
FIG. 1 is a schematic view illustrating an embodiment of an image forming apparatus according to the present invention.

FIG. 1 is a schematic view illustrating an embodiment of an image forming apparatus according to the present invention. The image forming apparatus is constituted as a laser beam printer using the electrophotographic process, and has a printer portion A and an image reading portion (image scanner) B mounted thereon.

First, the image reading portion B is described. The image reading portion B has an original glass plate 31 fixed on an upper surface of the apparatus. An original G is mounted on the original glass plate 31 with a portion to be copied being mounted facedown, and an original pressure cover which is not shown in FIG. 1 covers the original to complete the setting.

The image reading portion B photoelectrically reads the image information on the original G as time-series electric digital pixel signals (image signals), and is provided with an image reading unit 32 having a lamp for illuminating the original, a short focus lens array, and a CCD sensor all integrated therewith. By pressing down a COPY button, the image reading unit 32 below the original glass plate 31 is moved from its home position shown by solid lines on the left side of the original glass plate 31 to the right to reach its predetermined end point. When the unit 32 reaches its end point, it reverses its movement to return to the home position.

During the image reading unit 32 is moved to the right toward the end point, the downward faced image surface of the original G on the original glass plate 31 is illuminated and scanned from the left to the right by the lamp for illuminating the original of the unit 32. The illuminating and scanning light is reflected by the surface of the original, and the reflected light is imaged by the short focal length lens array and enters the CCD sensor.

The CCD sensor is formed of a light receiving portion, a transfer portion, and an output portion. The CCD light receiving portion converts a light signal into a charge signal. The transfer portion sequentially transfers the charge signal synchronously a clock pulse. The output portion converts the charge signal into a voltage signal, amplifies the signal, lower the impedance of the signal, and outputs the signal. An analog signal obtained in this way is subject to well-known image processing to be converted into a digital image signal, and is sent to the printer portion A.

The printer portion A is provided with a photosensitive drum (drum-shaped electrophotographic photosensitive member) 1 as an image bearing member. In the present embodiment, the photosensitive drum 1 is formed of a negatively chargeable OPC photosensitive member having a charge injection layer on the surface thereof. The photosensitive drum 1 is driven to rotate about the central supporting axis counterclockwise as shown by an arrow at a predetermined peripheral speed, 100 mm/s in the present embodiment. During the photosensitive drum 1 is in a rotating process, its surface is uniformly charged in the negative polarity by a magnetic brush charger 2. The photosensitive drum 1 and the magnetic brush charger 2 are described in the following.

The printer portion A has a laser scanning portion (laser scanner) 3 formed of a light emitting signal generator, a solid laser element, a collimator lens system, a rotatable polygon mirror, and the like. The laser scanning portion 3 carries out scanning and exposure L on the surface of the uniformly charged photosensitive drum 1 with a laser beam modulated correspondingly to the image signal sent from the image reading portion to form on the surface of the photosensitive drum 1 an electrostatic latent image corresponding to the image information of the original G.

When an image signal from the image reading portion B is inputted to the laser scanning portion 3, the light emitting signal generator generates a light emitting signal based on the image signal to turn on or off the solid laser element at predetermined timing. The laser beams emitted from the solid laser element in this way are converted to substantially parallel light beams by the collimator lens system, and are further made to reciprocate and scan in the longitudinal direction of the photosensitive drum 1 (sub-scanning direction) by the polygon mirror rotating at a high speed and carry out spot-like imaging on the surface of the photosensitive drum 1 by an fθ lens group. By the scanning by the laser beams, exposure distribution for one scanning of the image is formed on the surface of the photosensitive drum. Further, by incrementally scrolling the surface perpendicularly to the scanning direction after each scanning is completed, exposure distribution corresponding to the image signals can be obtained on the surface.

The electrostatic latent image formed on the photosensitive drum 1 is developed by a developing device 4 and is visualized as a toner image. In the present embodiment, the developing device 4 adopts the two-component contact developing method and the reversal developing method, which is described in the following.

On the other hand, from within a sheet feed cassette 5 attached to the outside of the printer portion A, a transfer material P as a recording medium contained in the sheet feed cassette 5 is taken out one by one by a pickup roller 5*a*. The transfer material P is supplied through a registration roller 5*b* in the printer portion A to a transfer portion T where the photosensitive drum 1 and a belt type transfer device 6 come in contact with each other, and the toner image formed on the photosensitive drum 1 is electrostatically transferred to the front surface of the transfer material P.

The transfer device 6 has an endless transfer belt 6*a* which is wound around a driving roller 6*b* and a driven roller 6*c*. The transfer belt 6*a* is rotated in the forward direction with respect to the direction of rotation of the photosensitive drum 1 at substantially the same speed. A transfer charge blade 6*d* is disposed inside the transfer belt 6*a*. The transfer charge blade 6*d* presses an upper track portion of the transfer belt 6*a* against the photosensitive drum 1 to form a transfer nip portion T, and, by applying transfer bias from a power source S3, carries out charging from the back surface of the transfer material P in the opposite polarity to that of the toner. By this, the toner image on the photosensitive drum 1 is sequentially transferred electrostatically to the front surface of the transfer material P passing through the transfer portion T.

In the present embodiment, a polyimide resin film at the thickness of 75 μm is used as the transfer belt 6*a*. However, the material of the transfer belt 6*a* is not limited to polyimide, and plastic such as polycarbonate resin, polyethylene terephthalate resin, polyvinylidene fluoride resin, polyethylene naphthalate resin, polyether ether ketone resin, polyether sulfon resin, and polyurethane resin, or rubber of the fluorine system or the silicone system can be suitably used. Also, the thickness is not limited to 75 μm, and thickness of about 25 to 2000 μm, preferably 50 to 150 μm is suitably used.

As the transfer charge blade 6*d*, one having the resistivity of $10^5$ to $10^7$ Ωcm, the thickness of 2 mm, and the length of 306 mm is used. During the transfer, transfer bias of +15 μA is applied to the transfer charge blade 6*d* under constant current control.

The transfer material P to which the toner image transferred at the transfer portion T is sequentially separated from the surface of the photosensitive drum 1, and is conveyed to a fixing device 8 by a conveying device 7. There, the toner image is fixed to the transfer material P which is outputted as a copy or a print.

Toner remains on the surface of the photosensitive drum 1 after the toner image is transferred to the transfer material P. Collection simultaneous with developing is a method which collects the toner remaining on the photosensitive drum after the transfer using fog removal bias (the potential difference Vback between the DC voltage applied to the developing device and the potential on the surface of the photosensitive member) in developing processes for the next and subsequent image formations, namely in the development of an electrostatic latent image after continuously charging the photosensitive drum, exposing the photosensitive drum to form an electrostatic latent image. According to this method, the toner remaining after the transfer is collected in the developing device to be reused in development in the future, and thus, waste toner can be eliminated and trouble in the maintenance can be saved. Further, since there is no cleaner, the advantages from the viewpoint of the space for the apparatus, the cost or the like are also great.

The polarity of the toner remaining on the surface of the photosensitive drum after the transfer is often reversed due to separation electric discharge in transfer or the like. Such toner the polarity of which is reversed is difficult to collect simultaneously with developing using the developing device 4.

Accordingly, in the present embodiment, toner having a specially large amount of charge in the negative polarity among the toner remaining after the transfer is temporarily captured by a fur brush charger with positive bias applied thereto as an auxiliary contact member. After the charge is eliminated or charging in the positive polarity is carried out, the toner is again released onto the surface of the photosensitive drum 1.

This makes the toner remaining after the transfer which goes to the magnetic brush charger 2 as the next main contacting and charging member is in the positive polarity or has only a small amount of charge in the negative polarity, reaches a charge nip portion n, and is taken in by a magnetic brush portion 23 (temporary collection of the toner remaining after the transfer by the magnetic brush charger). Here, by applying not only negative bias but also alternating voltage to the magnetic brush charger 2, vibration effect due to the AC electric field between the photosensitive drum 1 and the magnetic brush charger 2 is caused, which facilitates taking in of the toner remaining after the transfer by the magnetic brush portion 23.

The toner remaining after the transfer taken in by the magnetic brush portion 23 becomes normally charged (in the present embodiment, negatively charged) toner by rubbing of the magnetic brush. Simultaneously with the charging, the toner is released from the magnetic brush portion 23 onto the surface of the photosensitive drum 1 to reach a developing region m, and, by the fog removal electric field applied to the developing device 4 and by mechanically rubbing force, the developing device 4 collects the toner simultaneous with developing.

The photosensitive drum 1 is further described in the following. In the present invention, as the photosensitive drum 1, an ordinary organic photosensitive member or a photosensitive member using an inorganic semiconductor such as CdS, Si, or Se may be used. Preferably, one provided with a surface material layer having the volume resistivity of $10^9$ to $10^{14}$ Ωcm on an organic photosensitive member or an amorphous silicon photosensitive member is used. By using such a photosensitive drum, charge injection charging is materialized, generation of ozone is effectively prevented, the electric power consumption is effectively lowered, and the chargeableness can be improved.

Figure 2:
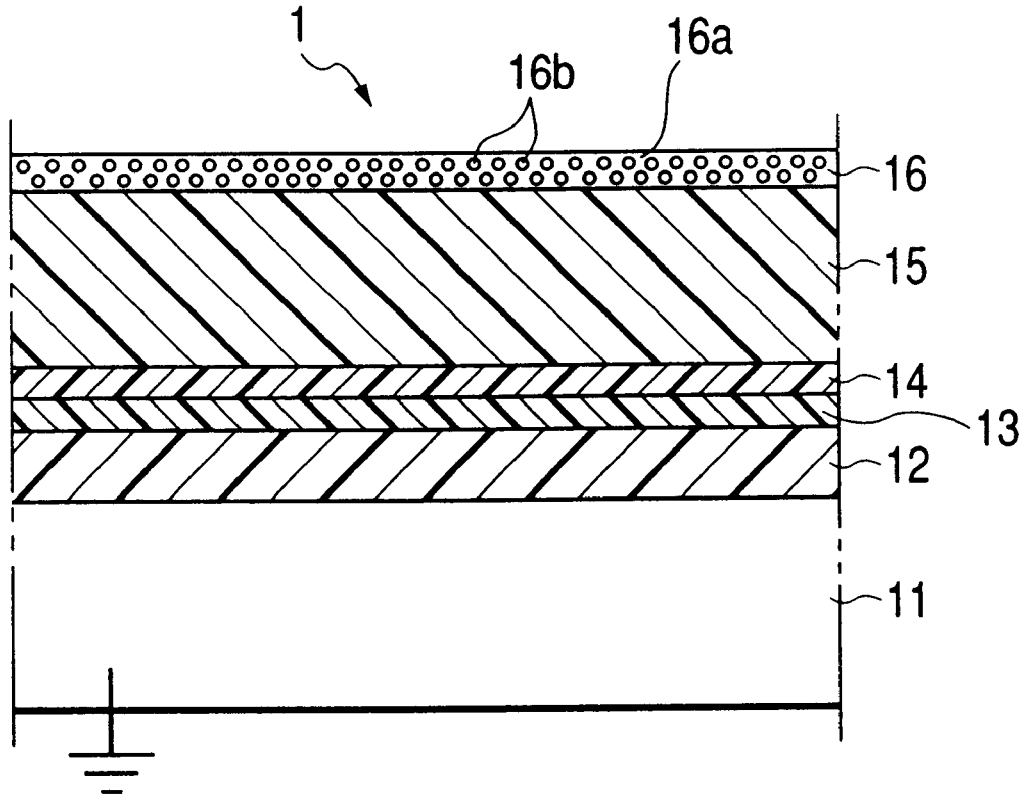
FIG. 2 is a sectional view illustrating the constitution of photosensitive layers of a photosensitive drum provided in the image forming apparatus in FIG. 1.

In the present embodiment, a photosensitive drum formed of a negatively chargeable organic photoconductor (OPC) provided with photosensitive layers having laminated five layers, i.e. first to fifth layers from the bottom on a drum substrate made of aluminum having the diameter of 30 mm. The constitution is now described with reference to FIG. 2.

The first layer is an undercoat layer 12, and is formed of a conductive layer having the thickness of 20 μm provided for the purpose of leveling the defects and the like of a drum substrate 11 of aluminum. The second layer is a positive charge blocking layer 13 for preventing positive charge injected from the drum substrate 11 from canceling the negative charge on the surface of the photosensitive drum. The positive charge blocking layer 13 is formed of a medium-resistance layer having the thickness of 1 μm made of amilan resin and methoxymethylated nylon and regulated to have the volume resistivity of about $10^6$ Ωcm.

The third layer is a charge generation layer 14 having the thickness of about 0.3 μm where a diazo pigment is dispersed in a resin. The charge generation layer 14 generates pairs of positive and negative charge by being exposed to light. The fourth layer is a charge transport layer 15 which is a p type semiconductor layer formed by dispersing hydrazone in polycarbonate resin. Therefore, negative charge given to the photosensitive drum can not move in this layer, only positive charge generated in the charge generation layer 14 can be transported to the surface of the photosensitive drum.

The fifth layer is a charge injection layer 16 which is a coating layer where ultrafine $SnO_2$ particulates **16*b* are dispersed in a binder 16*a* of an insulating resin. More specifically, this is a coating layer of a material formed by dispersing in the insulating resin about 70 weight % of $SnO_2$ particulates which have the particle diameter of about 0.03 μm and the resistivity of which is lowered (which is made to be conductive) by doping antimony as a light-transmitting insulating filler. The charge injection layer 16** is formed by preparing the coating liquid from the above materials and by applying it at the thickness of about 3 μm in an appropriate coating method such as the dipping coating method, the spray coating method, the roll coating method, or the beam coating method.

The volume resistivity of the photosensitive drum 1 is $10^{13}$ Ωcm. By controlling the volume resistivity to be at such a value, the direct chargeableness is improved which makes it possible to obtain a high quality image. The photosensitive drum 1 is not limited to an OPC photosensitive member and may also be materialized by an a-Si drum. In such a case, further durability can be attained.

Here, the volume resistivity of the photosensitive drum 1 is measured by disposing metal electrodes at intervals of 200 μm, making the coating liquid of the charge injection layer of the photosensitive drum 1 flow between the electrodes to form a film, and applying voltage of 100 V between electrodes at the temperature of 23° C. and at the humidity of 50% RH.

Figure 3:
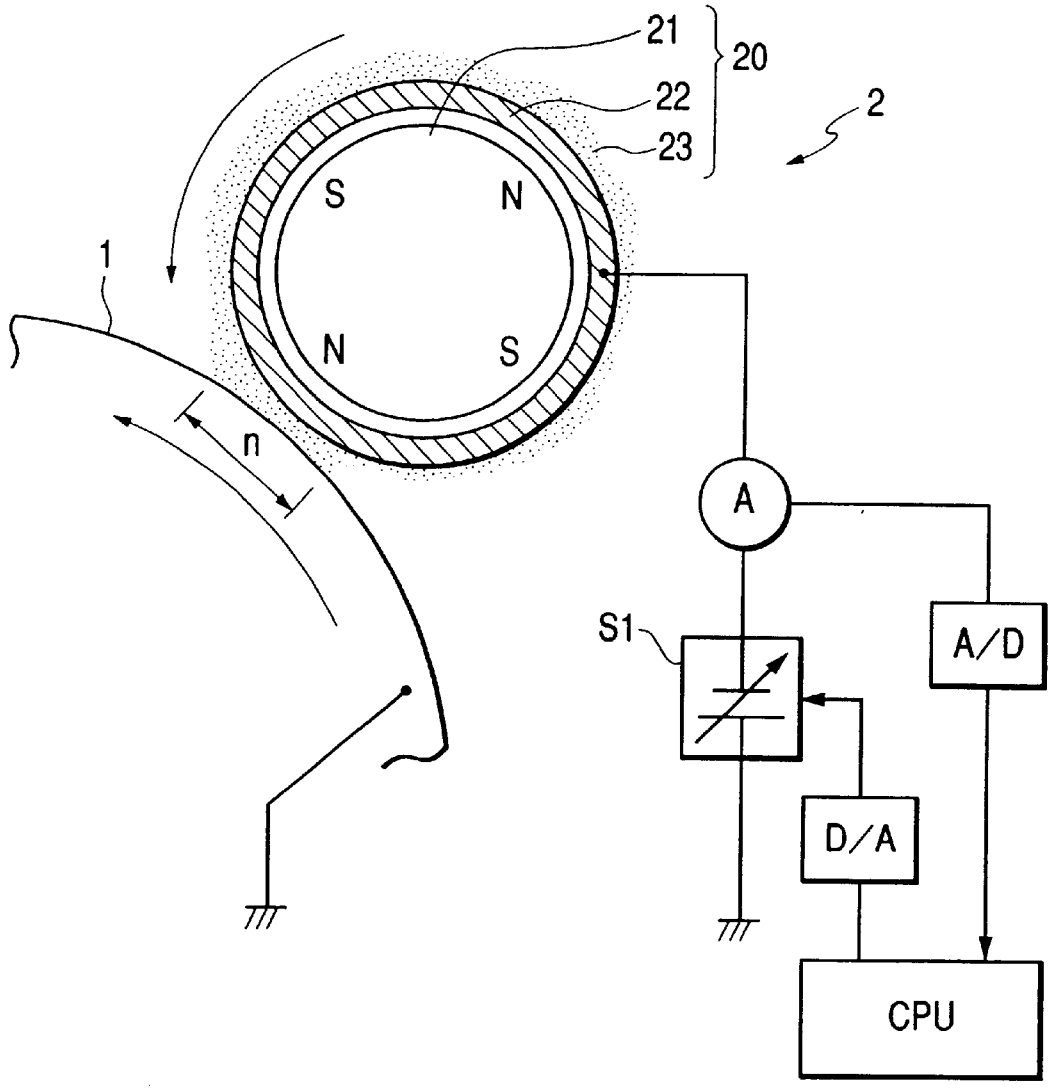
FIG. 3 is a sectional view illustrating a magnetic brush charger provided in the image forming apparatus in FIG. 1.

The magnetic brush contact charger, which is abbreviated as the magnetic brush charger 2 is, as shown in FIG. 3, formed of a magnetic brush charging portion 20 formed to be brush-like for bearing magnetic particles 23 on a conductive non-magnetic rotatable sleeve 22 having the outside diameter of 16 mm using magnetic power of a roller-like magnet 21 unrotationally disposed within the magnetic brush charging portion 20, and a charging bias applying power source S1 connected to the sleeve 22. With the brush-like magnetic particles 23 being in contact with the surface of the photosensitive drum 1, charging bias is applied from the power source S1 to the sleeve 22. As the sleeve 22 rotates, the magnetic particles 23 in contact with the surface of the photosensitive drum 1 are conveyed and the surface of the photosensitive drum 1 is charged.

As the magnetic particles (PCF) 23 of the contacting and charging member, ones having the average particle diameter of 10 to 100 $\mu$m, the saturation magnetization of 20 to 250 emu/cm$^3$, and the resistivity volume resistivity rate) of $10^2$ to $10^{10}$ Ωcm can be used. Taking into consideration of the presence of insulation defects of the photosensitive drum such as pinholes, it is preferable that the resistivity is $10^6$ Ωcm or more. Since, in order to make satisfactory the charging performance, it is preferable to use magnetic particles having the smallest possible resistivity, the magnetic particles used in the present embodiment as a typical example have the average particle diameter of 30 $\mu$m, the saturation magnetization of 200 emu/cm$^3$, and the volume resistivity of $5\times10^6$ Ωcm. The average particle diameter of the magnetic particles is shown as the largest chord length in the horizontal direction, and is measured with a microscope by randomly selecting 300 or more particles, actually measuring their diameters, and calculating the arithmetic mean. The particle size distribution of the magnetic particles and the like are further described in the following.

The resistivity value of the magnetic particles is measured by putting 2 g of the magnetic particles in a metal cell having the base area of 228 mm$^2$, applying the pressure of 6.6 kg/cm$^2$, and applying the voltage of 100 V.

In measuring the magnetic characteristics of the magnetic particles, a DC magnetization B-H characteristic automatic recording recorder BHH-50 of Riken Denshi K. K. can be used. In this case, the magnetic particles are filled into a cylindrical container having the inside diameter of 6.5 mm and the eight of 10 mm with the load being about 2 gf, the particles are made to be stationary in the container, and the saturation magnetization is measured from the B-H curve.

As the magnetic particles, resin magnetic particles where magnetite as a magnetic material is dispersed in a resin and carbon black is further dispersed for making the particles conductive and for regulating the resistivity, particles where the surface of simple substance magnetite such as ferrite is oxidized or reduced to regulate the resistivity, particles where the surface of simple substance magnetite such as ferrite is coated with resin to regulate the resistivity, or the like is used. In the present embodiment, particles where the surface of ferrite is oxidized or reduced to regulate the resistivity is used.

In the present embodiment, as described in the above, the surface of the photosensitive drum 1 is provided with the charge injection layer 16, and thus, the photosensitive drum 1 is charged by charge injection charging. More specifically, by applying predetermined charging bias to the non-magnetic sleeve 22, charge from the brush-like magnetic particles 23 on the sleeve 22 is given to the photosensitive drum 1 to charge the surface of the photosensitive drum 1 at a potential corresponding to the charging bias voltage. The non-magnetic sleeve 22 tends to be charged more uniformly as the rotational speed becomes higher.

In the present embodiment, the magnetic brush charging portion 20 is disposed with respect to the photosensitive drum 1 such that the contact nip width (charging region width) n between the brush-like magnetic particles 23 and the photosensitive drum 1 is about 5 mm. The non-magnetic sleeve 22 is rotated as shown by an arrow in the reverse direction with respect to the direction of rotation of the photosensitive drum 1, with the rotational speed of the sleeve 22 being 150 mm/s while the rotational speed of the photosensitive drum 1 is 100 mm/s. Constant voltage control is carried out with regard to the DC bias of −550 V from the power source S1 to the sleeve 22. Rectangular wave AC voltage of 1000 Hz and 700 Vpp (peak-to-peak voltage) is applied so as to be superimposed to charge the photosensitive drum 1 at about −550 V.

The developing device 4 used in the present invention is now described. In the present invention, the developing device 4 adopts the two-component contact developing method (two-component magnetic brush contact developing method).

Generally, developing methods of an electrostatic latent image may be roughly broken down into four: (a) non-magnetic toner of a monocomponent developer is made to coat the developing sleeve using a blade or the like, or magnetic toner is made to coat the developing sleeve using magnetic power, the toner is conveyed by the developing sleeve to the developing portion opposed to the photosensitive drum, and the development is carried out at the developing portion with the toner being not in contact with the photosensitive drum (the monocomponent non-contact developing method); (b) the development is carried out with the above-described toner being in contact with the photosensitive drum (the monocomponent contact developing method); (c) a two-component developer having non-magnetic toner and magnetic carrier mixed therein is borne on the developing sleeve using magnetic power, the developer is conveyed to the developing portion opposed to the photoconductive drum, and the development is carried out with the developer being not in contact with the photosensitive drum (the two-component non-contact developing method); and (d) the development is carried out with the above developer being in contact with the photosensitive drum (the two-component contact developing method). Among them, from the viewpoint of higher quality and higher stability of the image, the two-component contact developing method of (d) is frequently used.

Figure 4:
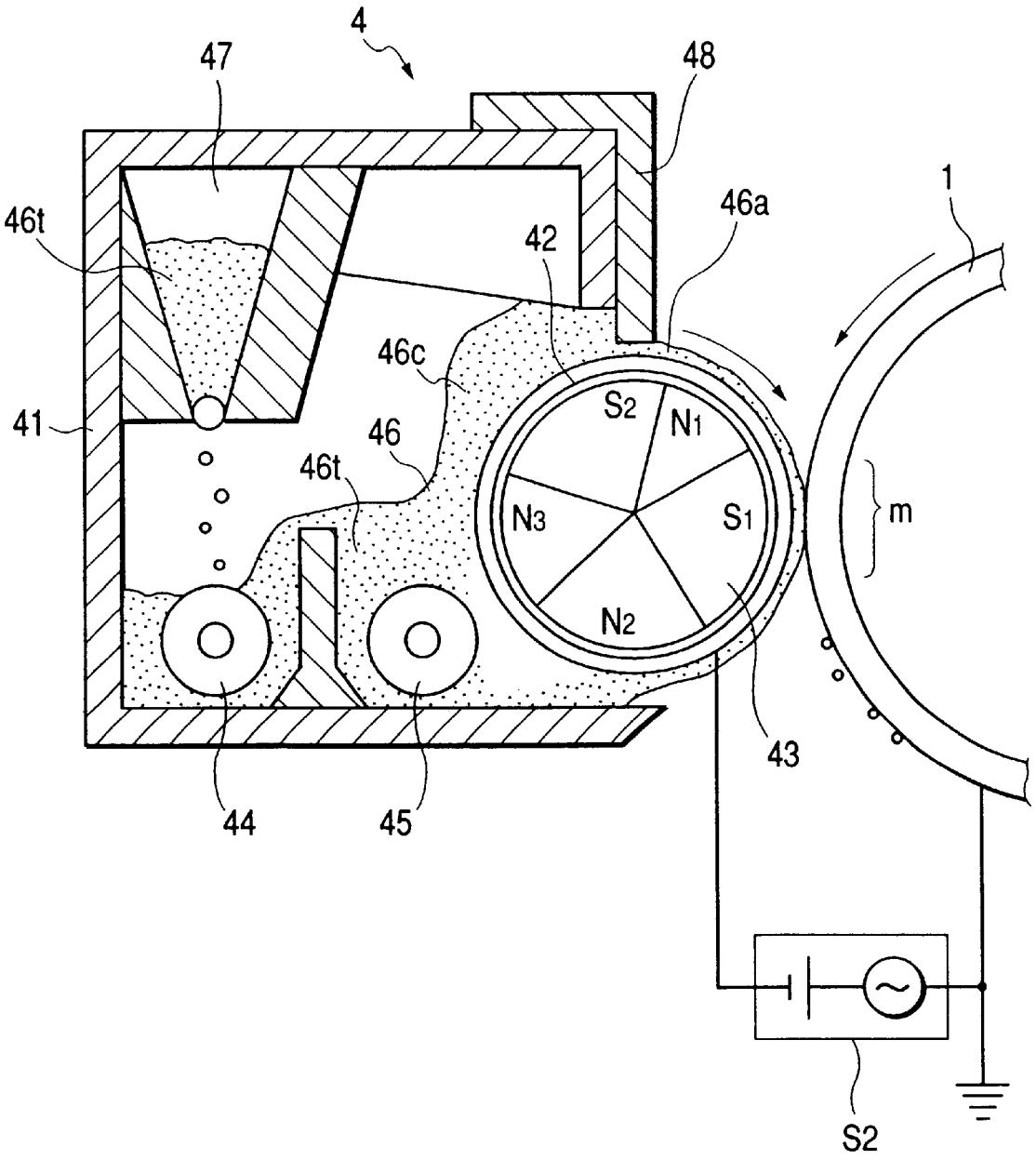
FIG. 4 is a sectional view illustrating a developing device provided in the image forming apparatus in FIG. 1.

In the present embodiment, the developing device 4 is, as shown in FIG. 4, basically provided with a developer container 41 containing a two-component developer 46 having non-magnetic toner 46*t* and magnetic carrier 46*c* mixed therein, a developing sleeve 42 for bearing the developer and for conveying the developer to the developing portion opposed to the photoconductive drum 1, a magnet roller 43 unrotationally disposed within the developing sleeve 42, agitating screws 44 and 45 for circulating the developer in the developer container 41 and for supplying the developer to the developing sleeve 42, and a regulating blade 48 for regulating the developer on the developing sleeve 42 so as to be formed as a thin layer.

The developing sleeve 42 is disposed such that the space between the developing sleeve 42 and the photosensitive drum 1 in the closest region is about 500 $\mu$m. The magnetic brush of the developer 46 borne on the developing sleeve 42 together with the photosensitive drum 1 form a development nip portion m in the developing region (developing portion) opposed to the photosensitive drum 1 such that the development is carried out with the developer being in contact with the surface of the photosensitive drum 1. The developing sleeve 42 is rotated in the forward direction with respect to the direction of rotation of the photosensitive drum 1.

The two-component developer 46 in the developer container 41 is drawn onto the rotating developing sleeve 42 by the magnetic force of a magnetic pole $N_3$ of the magnet roller 43. In the process of conveying the developer 46 from the magnetic pole $N_3$ through $S_2$ to $N_1$, the film thickness of the developer 46 is regulated by the regulating blade 48 disposed perpendicularly to the developing sleeve 42, and a thin layer 46*a* of the developer 46 is formed on the developing sleeve 42. The developer 46 formed as this thin layer is conveyed to the developing portion as the developing sleeve 42 is rotated. In the vicinity of the developing main pole Si of the magnet roller 43, due to the magnetic power of the developing main pole $S_1$, the developer 46 stands like the ears of rice on the developing sleeve 42 so that the developer 46 is formed into a magnetic brush.

The developer 46 formed into the magnetic brush comes in contact with the surface of the photosensitive drum 1 at the developing portion. The toner 46t in the developer 46 selectively attaches to the electrostatic latent image on the photosensitive drum 1 to carries out the development, and visualizes the latent image as a toner image. The developer after the development is returned to the inside of the developer container 41 by the developing sleeve 42, is separated from the developing sleeve 42 by repulsive magnetic field formed by magnetic poles N2 and N3 of the magnet roller 43, and is collected in the developer container 41.

During the development, developing bias formed by superimposing DC voltage and AC voltage is applied to the developing sleeve 42 from a power source S2. In the present embodiment, developing bias formed by superimposing AC voltage having the frequency Vf of 3000 Hz and the peak-to-peak voltage (amplitude) Vpp of 1500 V on DC voltage Vdc=−500 V is applied.

Generally, in the two-component developing method, when AC voltage is applied, the efficiency in the development is increased and the quality of the image becomes higher while there is the risk of increased tendency to generate fog. Therefore, typically, by providing potential difference between the DC voltage of the developing bias and the potential on the surface of the photosensitive member 1, such fog is prevented. The potential difference for preventing fog is referred to as fog removal potential (Vback). In the development, this potential difference prevents the toner from attaching to a region where no image is to be formed of the photosensitive drum 1.

In the developer 46 in the developer container 41, toner 46*t* is consumed by the development and the toner density (mixing ratio with respect to the magnetic carrier) is gradually lowered. The toner density of the developer 46 in the developer container 41 is detected by a density detecting means which is not shown in FIG. 4. When the toner density is lowered to a predetermined allowable lower limit density, the toner 46*t* is supplied to the developer 46 from a toner supplying portion 47 in the container 41 to control the toner density of the developer 46 so as to be held within a predetermined allowable range.

In the present embodiment, as the toner 46t of the two-component developer 46, negatively charged toner having the average particle diameter of 6 μm is used with 1 weight % of titanium oxide having the average particle diameter of 20 nm being added thereto. As the magnetic carrier 46*c* of the two-component developer 46, magnetic carrier having the saturation magnetization of 150 emu/cm$^3$ and the average particle diameter of 40 μm is used. In particular, the magnetic carrier is formed by dispersing magnetic particles and a resistivity regulating agent in a resin and carrying out resin coating, and has the resistivity of about $5\times10^{12}$ Ωcm when measured in the same way as the resistivity measurement of the magnetic particles (PCF) of the magnetic brush charger 2. The mixing ratio of the toner to the magnetic carrier in the developer 46 is 6:94 in weight.

As the volume average particle diameter of the toner, for example, one measured according to the following method is used.

As the measuring equipment, COULTER COUNTER TA-II (manufactured by COULTER K.K.) is used to which an interface (manufactured by Nikkaki K.K.) and a CX-i personal computer (manufactured by Canon Inc.) are connected for outputting number average distribution and volume average distribution. First class sodium chloride is used as the electrolyte to prepare 1% NaCl aqueous solution.

0.1 to 5 ml of a surface-active agent, preferably an alkylbenzene sulfonate as a dispersing agent is added to 100 to 150 ml of the above electrolyte, and further, 2 to 20 mg of the toner as the sample to be measured is added. The electrolyte with the sample being suspended therein is dispersed for about 1 to 3 minutes with an ultrasonic dispersing device. Using an aperture of 100 μm of the above-described COULTER COUNTER TA-II, the particle size distribution of the toner particles of 2 to 40 μm is measured, and then, the volume average particle diameter of the toner is found.

In the present invention, the particle size distribution of the magnetic particles (PCF) for charging which is used in the magnetic brush charger 2 is now described in the following.

Suppose that $$A=\log Rv/Rc,\ B=lv/lc$$

$$\alpha=\tfrac{1}{5}\cdot B/A\cdot lv,\ \beta=B/A\cdot lv$$

wherein lc is the average particle diameter of the magnetic particles for charging, lv is the average particle diameter of the magnetic carrier for developing, Rc is the resistivity of the magnetic particles for charging measured according to the above-described method, and Rv is the resistivity of the magnetic carrier for developing, and common logarithm is represented as log.

Let C (%) be the ratio in volume of magnetic particles for charging having the particle diameters ranging from α to β to the whole magnetic particles. As a matter of course, C depends on the particle diameters α and β. In the present embodiment, the average particle diameter of the magnetic particles for charging lc=30 μm, the resistivity $Rc=5\times10^6$ Ωcm, the average particle diameter of the magnetic carrier for developing lv=40 μm, and the resistivity $Rv=5\times10^{12}$ Ωcm, and thus, A=6 and B=⅔. Therefore, α=1.8 μm and β=8.9 μm. In this case, C=1%.

Figure 5:
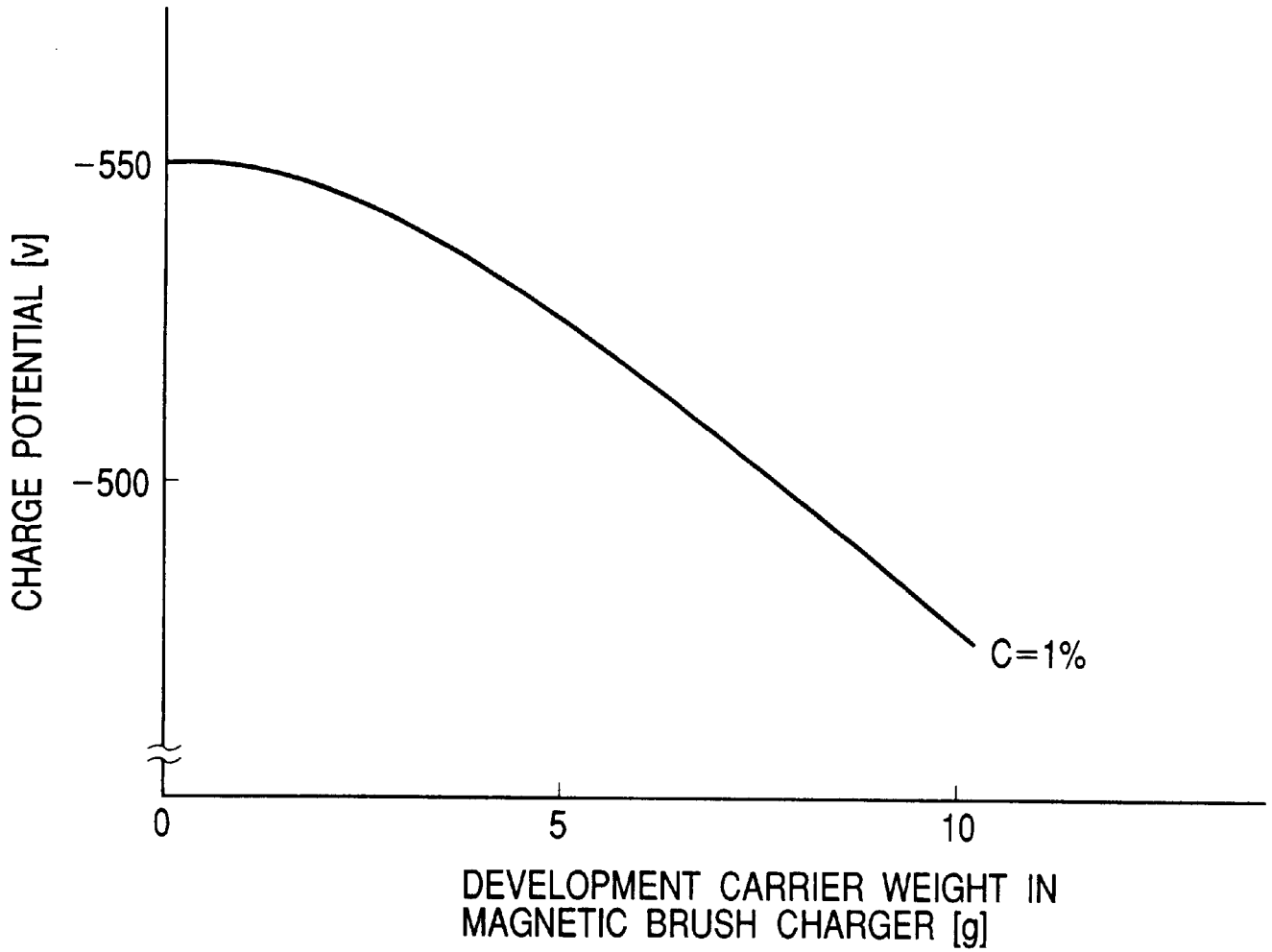
FIG. 5 is a graph showing change in the charge potential of the photosensitive drum with respect to the weight of development carrier collected and accumulated in case the ratio C of particles having predetermined particle diameters in magnetic particles of the magnetic brush charger in FIG. 3 is 1%.

FIG. 5 is a graph showing change in the charge potential of the photosensitive drum 1 with respect to the weight of the development carrier collected and accumulated in the magnetic brush charger 2 in an image formation experiment of the image forming apparatus of the cleanerless system shown in FIG. 1. In this experiment, the amount of the magnetic particles for charging is 50 g.

FIG. 5 indicates that, when the amount of the development carrier is 5 g or more, that is, 10% or more of the amount of the magnetic particles for charging, remarkable lowering of the charge potential is caused to lower the charging performance of the magnetic brush charger 2.

On the other hand, by grinding and classifying ferrite particles formed by sintering, ferrite particles having relatively small particle diameters can be obtained. By mixing such ferrite particles after being ground and classified, the particle size distribution of the magnetic particles for charging can be regulated.

Figure 6:
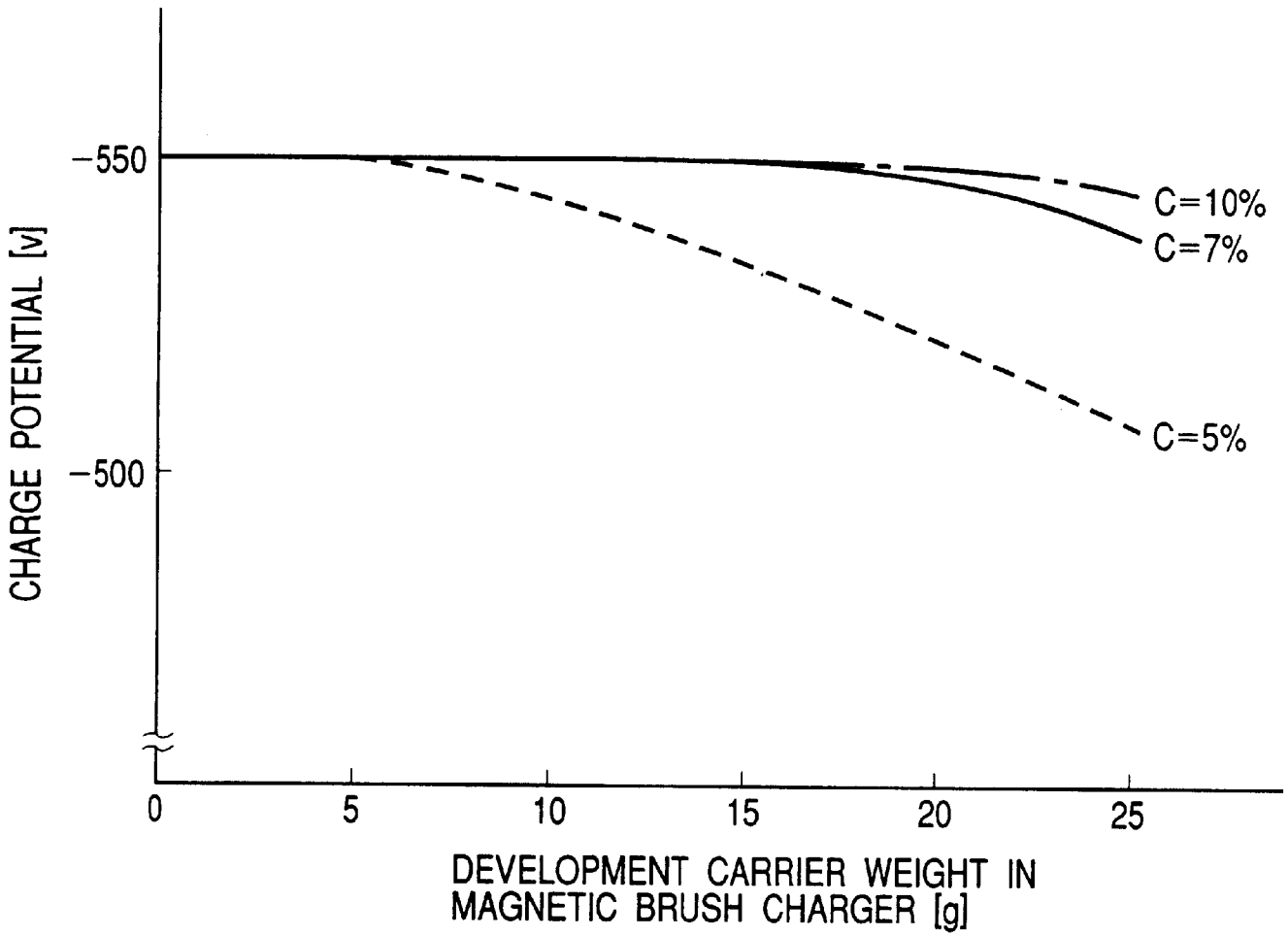
FIG. 6 is a graph showing change in the charge potential of the photosensitive drum with respect to the weight of development carrier collected and accumulated in case the ratio C of particles having predetermined particle diameters in magnetic particles of the magnetic brush charger in FIG. 3 is 5%, 7%, and 10%, respectively.

FIG. 6 is a graph showing change in the charge potential of the photosensitive drum 1 with respect to the weight of the development carrier collected and accumulated in the magnetic brush charger 2 when A=6 and B=⅘($\alpha$=1.8 $\mu$m and $\beta$=8.9 $\mu$m) in case C is 5%, 7%, and 10%, respectively.

FIG. 6 indicates that to make larger the value of C is effective in preventing the charging performance from being lowered due to mixing of the development carrier into the magnetic brush charger 2 and in prolonging the life of the charger 2. This is thought to be because, since the development carrier is mixed into the magnetic brush of the magnetic particles, the magnetic particles having smaller particle diameters prevent the conducting path of the magnetic brush from being blocked.

It is to be noted that, in FIG. 6, apparently the effect of maintaining the charging performance and of prolonging the life of the magnetic brush charger 2 is smaller in case C is increased from 7% to 10% than in case C is increased from 5% to 7%. This is thought to be because the resistivity value is increased due to impinging factors other than the development carrier, for example, attaching of the toner to the magnetic particles for charging, and the charging performance is lowered.

In particular, with regard to a photosensitive member provided with a charge injection layer and an amorphous silicon photosensitive member, from the viewpoint of maintaining the charging performance with the magnetic brush charging and preventing fog due to lowered Vback caused by charge injection at the developing portion, A≧2 is preferable, and, preferably, the average particle diameter of the magnetic particles for charging is the average particle diameter of the development carrier or smaller, that is, B≧1.

Figure 7:
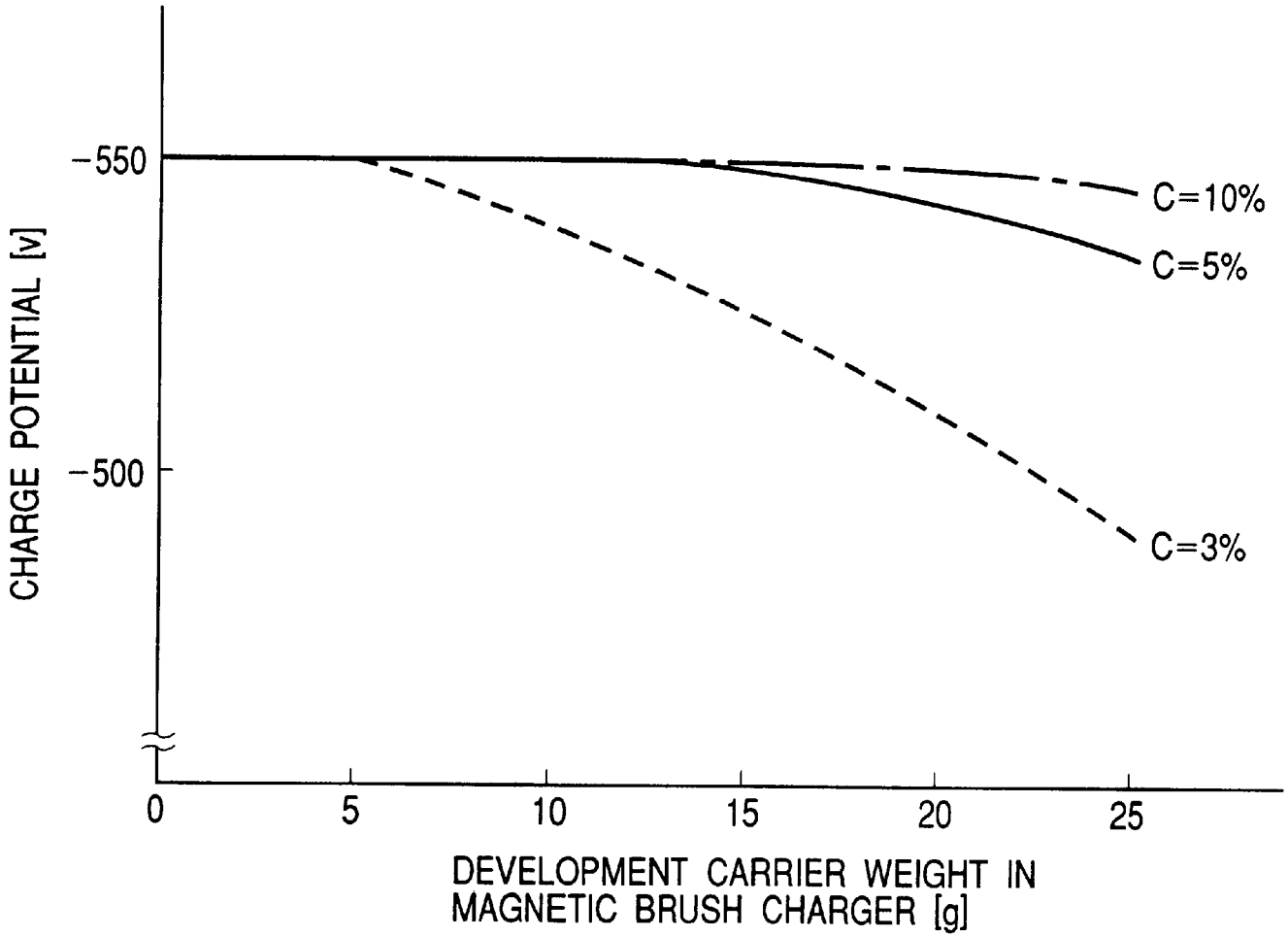
FIG. 7 is a graph showing change in the charge potential of another example of the photosensitive drum with respect to the weight of development carrier collected and accumulated in case the ratio C of particles having predetermined particle diameters in magnetic particles of the magnetic brush charger in FIG. 3 is 3%, 5%, and 10%, respectively.
Figure 8:
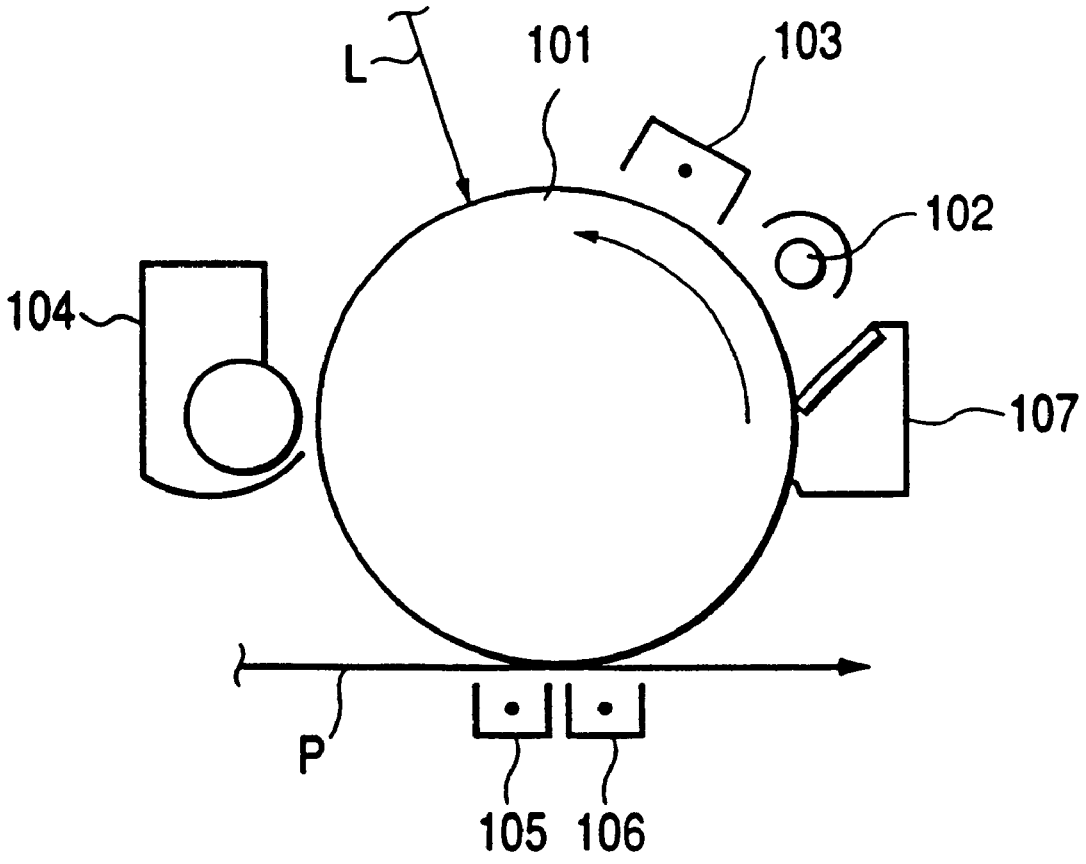
FIG. 8 PRIOR ART
FIG. 8 is a schematic view illustrating an image forming apparatus.

FIG. 7 is a graph showing change in the charge potential of the photosensitive drum 1 with respect to the weight of the development carrier collected and accumulated in the magnetic brush charger in an image formation experiment when A=2 (Rc=5×10$^6$ Ωcm and Rv=1×10$^8$ Ωcm) and B=1 (lv=lc=40 $\mu$m) and thus, $\alpha$=4 $\mu$m and $\beta$=20 $\mu$m in case C is 3%, 5%, and 10%, respectively. FIG. 7 indicates that there is an effect of maintaining the charging performance and of prolonging the life when C is 5% or more.

These experiments reveal that, in case A/B≧2, by at least making C equal or larger than 5%, the charging performance of the magnetic brush charger 2 can be maintained and the life of the magnetic brush charger 2 can be prolonged. Therefore, according to the present invention, when an image forming apparatus satisfies:

$$A=\log Rv/Rc,\ B=lv/lc$$

and $$\alpha=\tfrac{1}{5}\cdot B/A\cdot lv,\ \beta=B/A\cdot lv$$

wherein Rc is the volume resistivity of the magnetic particles of the magnetic brush charger, lc is the average particle diameter of the magnetic particles, Rv is the volume resistivity of the magnetic carrier of the two-component developer, and lv is the average particle diameter of the magnetic carrier, when $$A/B\geqq 2,\ C\geqq 5\%,$$

and further, when $$6\geqq A/B\geqq 2,\ C\geqq 7\%$$

wherein C is the ratio (%) in volume of magnetic particles having the particle diameters ranging from $\alpha$ to $\beta$ to the whole magnetic particles.

According to the present invention, the resistivity value of the development carrier is higher than that of the magnetic particles for charging, the charging performance of the magnetic brush charging is prevented from being lowered even when the development carrier is mixed into the magnetic brush charger, and thus, a satisfactory image without fog, unevenness in the image, and the like can be obtained for a long time.

While embodiments of the present invention are described in the above, it is to be understood that the invention is not limited to the disclosed embodiments, and various modifications may be made in the invention without departing from the spirit and the scope of the invention.

What is claimed is:

1. An image forming apparatus comprising:

an image bearing member for bearing an electrostatic image;

a charger for charging said image bearing member, said charger having magnetic particles for coming into contact with the image bearing member and a supporting member for supporting the magnetic particles by magnetic force with voltage applied thereto;

image forming means for selectively eliminating charge of said image bearing member charged by said charger to form an electrostatic image; and a developing device for developing the electrostatic image on said image bearing member with developer having toner and magnetic carrier, wherein said image forming apparatus satisfies the following relationship:

$$A/B\geqq 2,\ C\geqq 5$$

$$A=\log Rv/Rc,\ B=lv/lc$$

$$\alpha=\tfrac{1}{5}\cdot B/A\cdot lv,\ \beta=B/A\cdot lv$$

wherein Rc is a volume resistivity of the magnetic particles, lc is an average particle diameter of the magnetic particles, Rv is a volume resistivity of the magnetic carrier, lv is an average particle diameter of the magnetic carrier, and C is a ratio (%) in volume of the magnetic particles having the particle diameters ranging from $\alpha$ to $\beta$ to the whole magnetic particles.

2. An image forming apparatus as claimed in claim 1, wherein said apparatus further comprises a transfer charger for transferring a toner image on said image bearing member to a transfer material, said charger temporarily collecting toner remaining after the transfer on said image bearing member.

3. An image forming apparatus as claimed in claim 1, wherein said image bearing member includes a photoconductor layer and a surface layer provided on said photoconductor layer and containing conductive particles.

4. An image forming apparatus as claimed in claim 3, wherein a volume resistivity of said surface layer is 10$^9$ to 10$^{14}$ Ωcm.

5. An image forming apparatus as claimed in claim 1, wherein said image bearing member includes an amorphous silicon photoconductor layer.

6. An image forming apparatus as claimed in claim 3, wherein the following is satisfied:

when $$6 \geqq A/B \geqq 2,\ C \geqq 7.$$

7. An image forming apparatus as claimed in claim 1, wherein the magnetic carrier is resin particles with a magnetic material dispersed therein.

8. An image forming apparatus as claimed in claim 1, wherein the magnetic particles include sintered ferrite and ground ferrite.

9. An image forming apparatus as claimed in claim 1, wherein the following is satisfied:

$$B \geqq 1.$$

10. An image forming apparatus as claimed in claim 5, wherein the following is satisfied:

when $$6 \geqq A/B \geqq 2,\ C \geqq 7.$$

* * * * *

UNITED STATES PATENT AND TRADEMARK OFFICE

CERTIFICATE OF CORRECTION

PATENT NO. : 6,282,391 B1
DATED : August 28, 2001
INVENTOR(S) : Atsushi Takeda

It is certified that error appears in the above-identified patent and that said Letters Patent is hereby corrected as shown below:

Title page,
Item [57], ABSTRACT,
Line 11, “In case” should read -- When --;
Line 12, “$\beta$=B/A·1v” should read -- $\beta$=B/A·1v, --;
Line 18, “C≧5% wherein C (%) is the ratio” should read -- C≧5%, wherein C is the ratio (%) --; and
Line 20, “the” should read -- to the --.

Column 3,
Line 17, “by” should read -- collection by --.

Column 4,
Line 43, “in case” should read -- when --;
Line 49, “in case” should read -- when --; and
Line 56, “in case” should read -- when --.

Column 5,
Line 25, “During” should read -- When --;
Line 37, “a” should read -- with a --;
Line 39, “lower” should read -- lowers --; and
Line 52, “During” should read -- When --.

Column 6,
Line 54, “ether” should be deleted.

Column 7,
Line 37, “This makes the” should read -- The --; and “which” should be deleted; and
Line 57, “mechanically” should read -- mechanical --.

Column 8,
Line 6, “formed” should read -- is formed --;
Line 9, “i.e.” should read -- i.e., --; and
Line 28, “p type” should read -- p-type --.

Column 9,
Line 14, “volume” should read -- (volume --; and
Line 37, “of” should read -- manufactured by --.

UNITED STATES PATENT AND TRADEMARK OFFICE

CERTIFICATE OF CORRECTION

PATENT NO. : 6,282,391 B1
DATED : August 28, 2001
INVENTOR(S) : Atsushi Takeda

It is certified that error appears in the above-identified patent and that said Letters Patent is hereby corrected as shown below:

Column 11,
Line 12, “pole Si” should read -- pole $S_1$ --; and
Line 25, “poles N2 and N3” should read -- poles $N_2$ and $N_3$ --.

Column 13,
Line 21, “in case” should read -- when --;
Line 22, “in case” should read -- when --;
Line 42, “in case” should read -- when --; and
Line 46, “in case” should read -- when --.

Signed and Sealed this

Thirtieth Day of July, 2002

*Attest:*

*Attesting Officer*

JAMES E. ROGAN
*Director of the United States Patent and Trademark Office*